US006443879B1

(12) United States Patent
Chen

(10) Patent No.: US 6,443,879 B1
(45) Date of Patent: Sep. 3, 2002

(54) HEALTHY MACHINE ENABLING A HUMAN BODY TO HANG UPSIDE DOWN

(76) Inventor: Chin-Yi Chen, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/699,175

(22) Filed: Oct. 25, 2000

(51) Int. Cl.[7] ..... A63B 26/00
(52) U.S. Cl. ..... 482/144; 482/143; 601/23
(58) Field of Search ..... 482/142–145, 482/4; 128/897; 601/23, 24

(56) References Cited

U.S. PATENT DOCUMENTS 4,534,555 A * 8/1985 McGowen ..... 482/144
4,546,972 A * 10/1985 Goyer ..... 482/144
4,787,375 A * 11/1988 Krause ..... 128/897
5,785,631 A * 7/1998 Heidecke ..... 482/4

* cited by examiner

*Primary Examiner*—Glenn E. Richman

(57) ABSTRACT

A health machine for enabling an user to exercise upside down includes a support having a pair of circular seats on the top, a top bar having a pair disks at two ends rotatably engaged with the pair of circular seats and a massage assembly secured to the top bar. So that the massage assembly may rotate clockwise for about 90 degrees to facilitate the upper body of a user to hang upside down on massage in order to relax his vertebra and to improve the blood circulation in his body.

3 Claims, 9 Drawing Sheets

HEALTHY MACHINE ENABLING A HUMAN BODY TO HANG UPSIDE DOWN

BACKGROUND OF THE INVENTION

The present invention relates to gymnastic or health apparatus and more particularly to a health machine for enabling an user to exercise upside down to practice the vertebra of the body and to improve the blood circulation in the body.

Conventional health apparatus such as a massage or running machine is very popular but has limited health effect. FIG. 1 shows a blood circulation machine 10 which is structurally as a chair has a back 11 and a seat 12 with a vibration motor. When a human sits down on the seat, the motor provides proper power to vibrate his body. However, the result is limitative because of that the vertebra of the user could not stretch out.

SUMMARY OF THE PRESENT INVENTION

The present invention has a main object to provide a health machine for enabling an user to exercise upside down to stretch his vertebra out and to relax his vertebra without pressure.

Another object of the present invention is to provide a health machine for enabling an user to exercise upside down which massages his thigh and to improve the blood circulation in his body.

Further object of the present invention is to provide a health machine for enabling an user to exercise upside down which machine can be elevationally adjustable to fit to the height of the user.

Accordingly, the health machine of the present invention comprises generally an adjustable support and massage assembly rotatably disposed on the top of the support. When a man stands against the massage assembly and bows down his upper body, the massage assembly will turn clockwise for about 90 degrees. So that he is hanged upside down from the massage assembly which massages his thigh simultaneously.

The present invention will become more fully understood by reference to the following detailed description thereof when read in conjunction with the attached drawings.

DETAILED DESCRIPTION OF THE PREFERRED EMBODIMENT

With reference to FIGS. 2 to 6 of the drawings, the health machine for enabling an user to exercise upside down of the present invention comprises generally a support 20, a rotatable top bar 30 connected to the top of the support 20 and a massage assembly 40 sleeved on the top bar 30.

Figure 3:
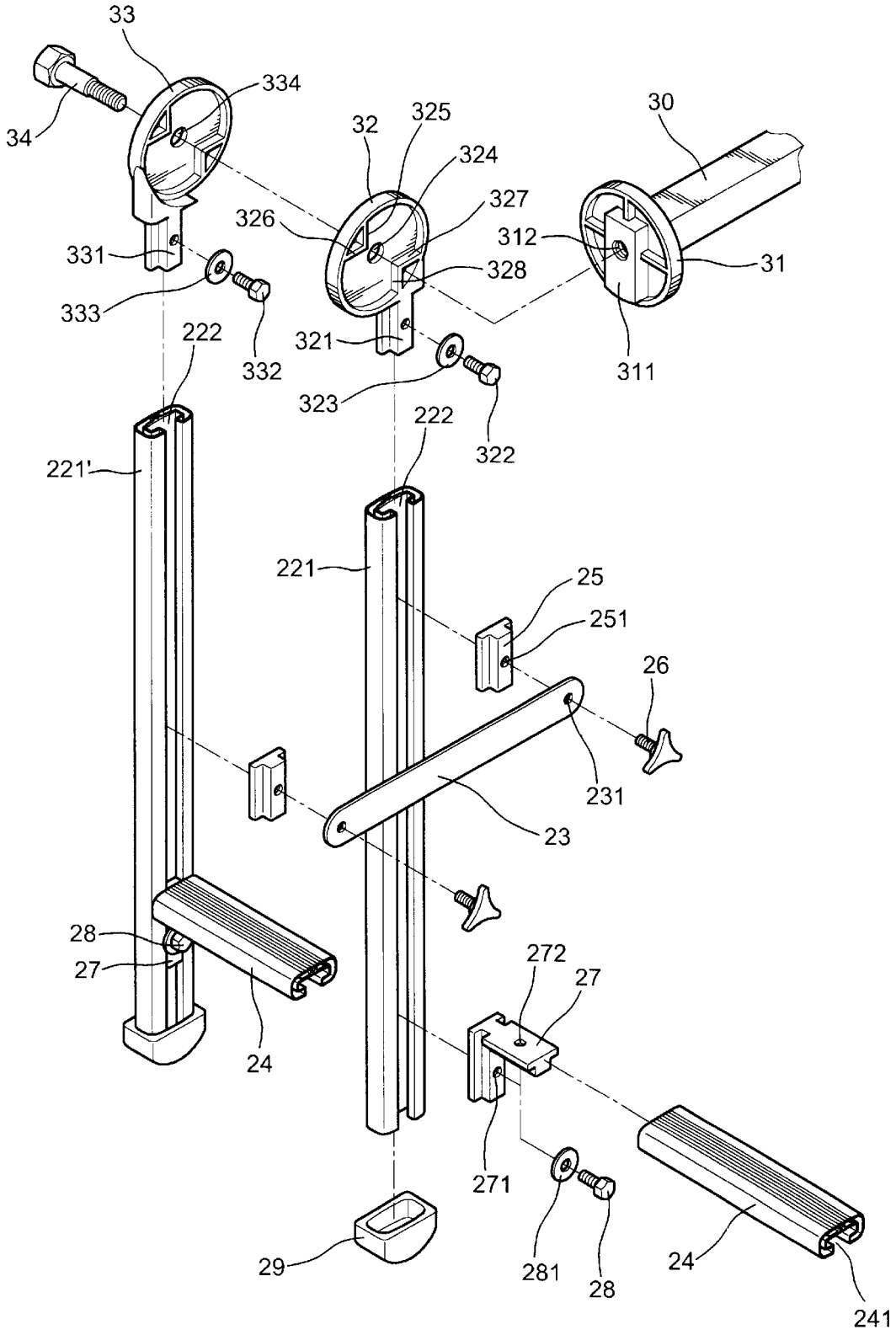
FIG. 3 is an exploded perspective view to show the support of the present invention.
Figure 4:
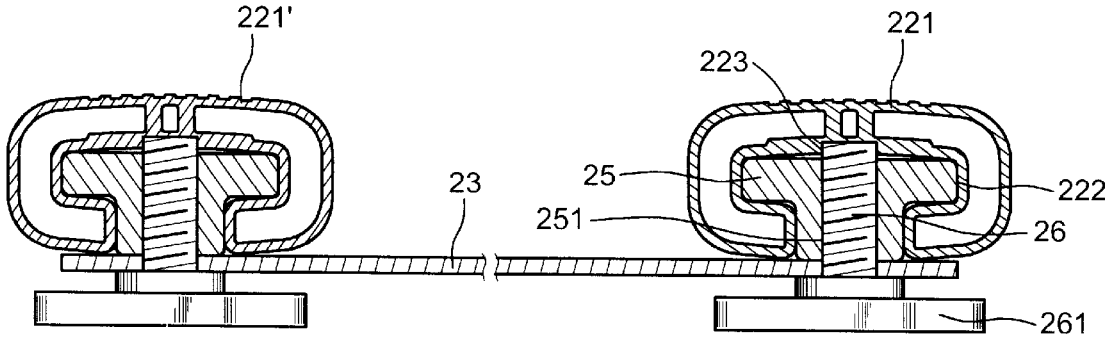
FIG. 4 is a sectional view to show the engagement of the spindle with the legs.
Figure 6:
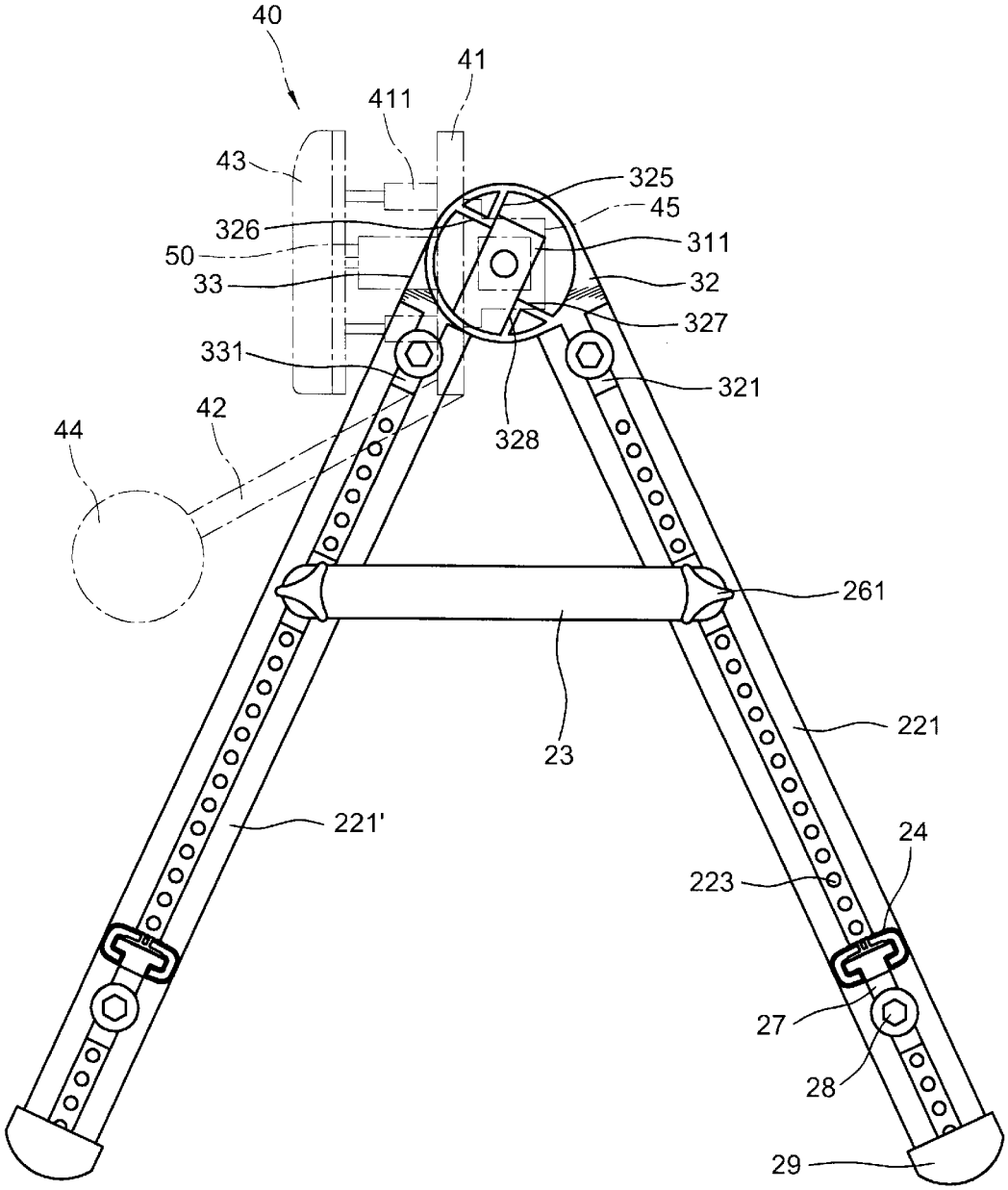
FIG. 6 is a sectional view to show an assembly of the health machine of the present invention.

The support 20 (as shown in FIG. 3) is composed of a pair of roughly A-shaped stands 21 and 22 which are connected by a pair of lower bars 24 and each having a pair of legs 211 and 221 adjustably connected by a spindle 23. Each of the legs 211 and 221 has an elongate guard 222 of T-shaped section extended along the length of the legs 211 and 221, a plurality of screw hole 223 centrally formed spaced apart in the guard 222 and extended along the length thereof (as shown in FIG. 6) and a foot 29 on the bottom. The spindle 23 has a thru hole 231 adjacent each end engageable with the screw hole 251 of a pair of slides 25 which are slidably engaged into the guard 222 and secured with two end of the spindle 23 by a pair of locks 26 through the thru hole 231 and the screw hole 251. A pair of L-shaped block 27 of T-shaped section each has a vertical portion slid into the lower portion of the guard 222 of the legs 221 and 221' respectively and secured by bolts 28 through a pair of screw holes 271 with a pair of washers 281 engaged therebetween and a transverse portion respectively inserted into two ends of the lower bars 24 each of which has also a T-shaped guard 241 extended along the length engageable with the transverse portion of the blocks 27.

Figure 1:
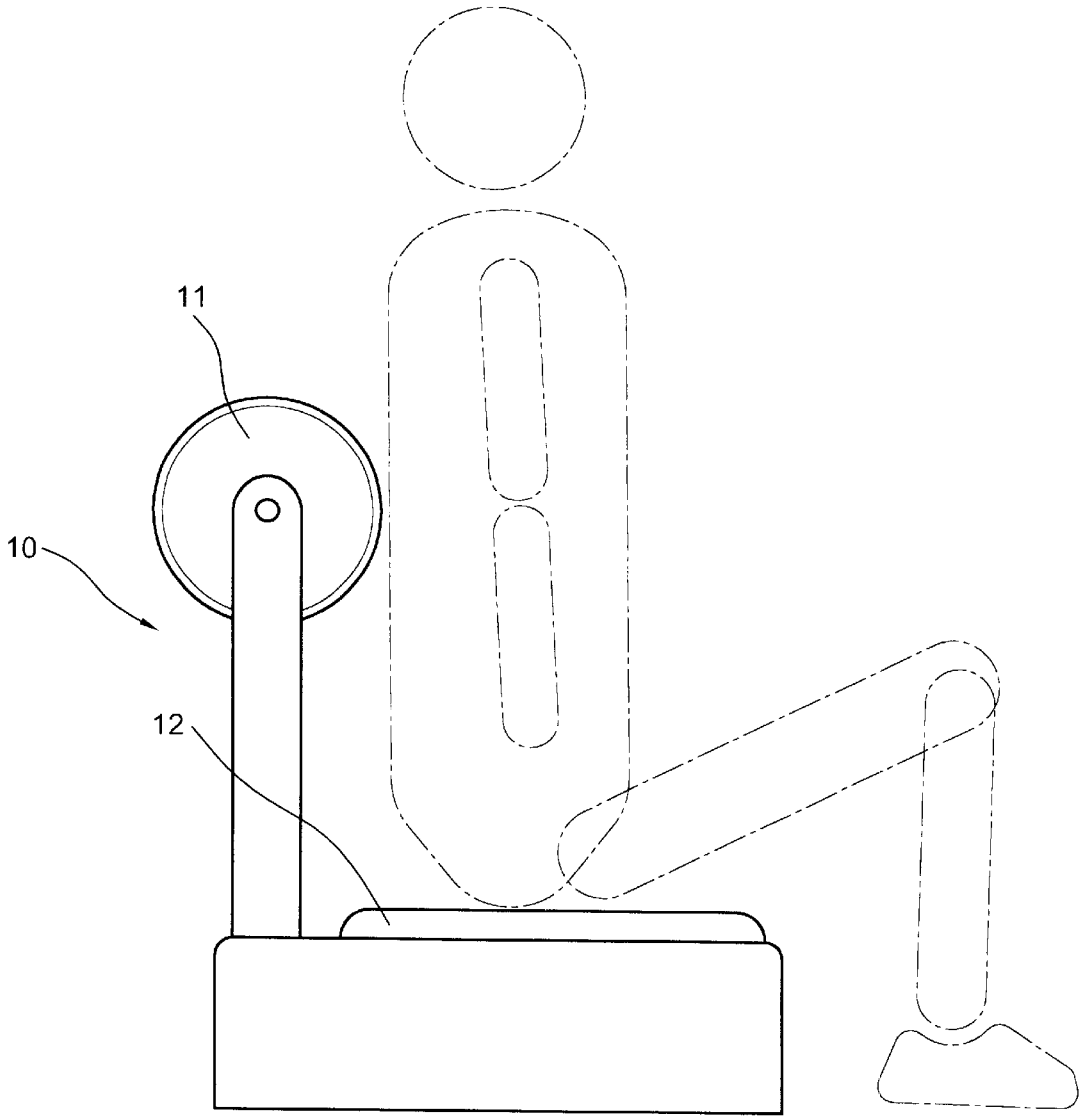
FIG. 1 Prior Art
FIG. 1 is a plane view to show a health machine according to a prior art.
Figure 2:
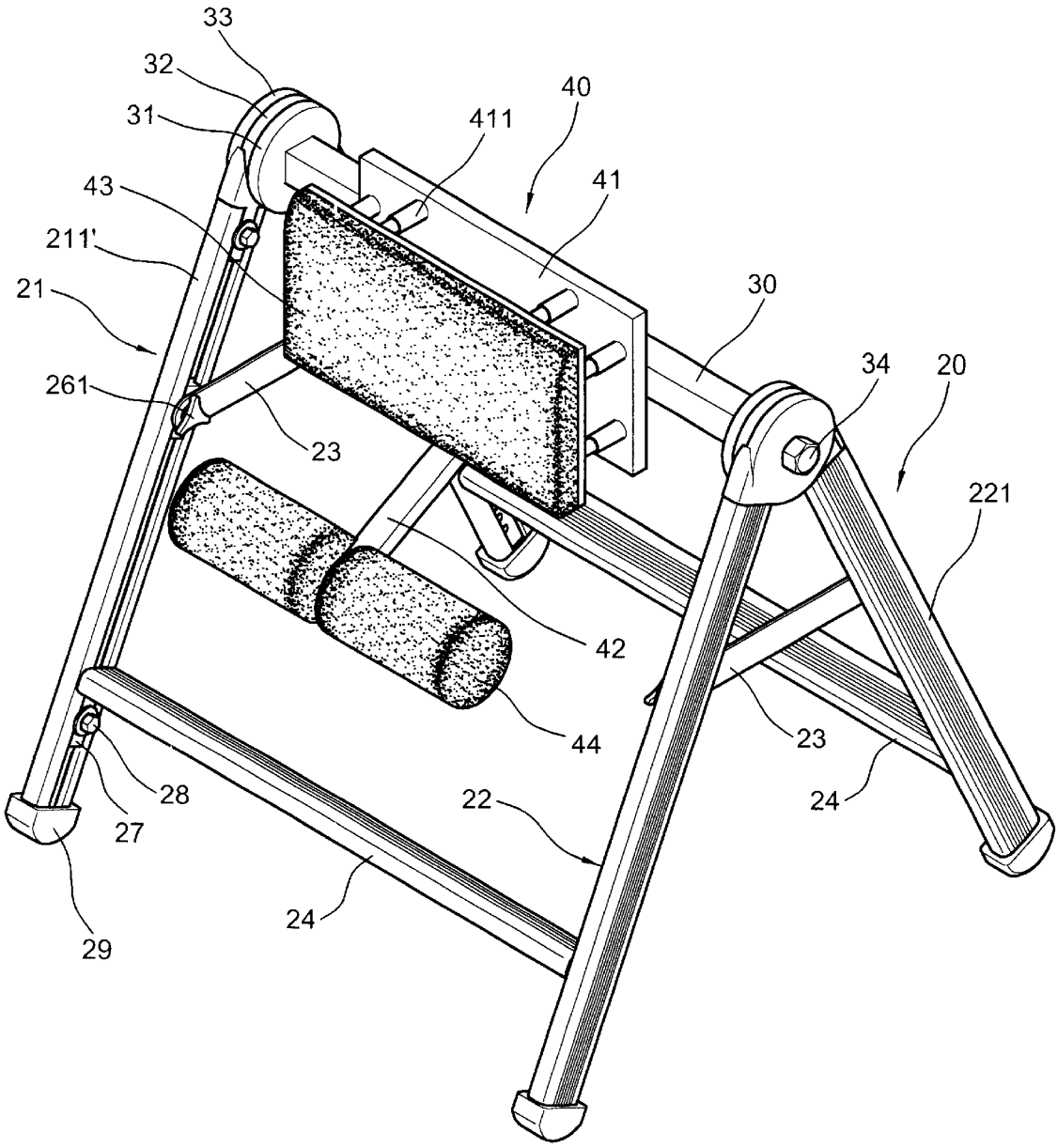
FIG. 2 is a perspective view to show a health machine according to the preferred embodiment of the present invention.
Figure 5:
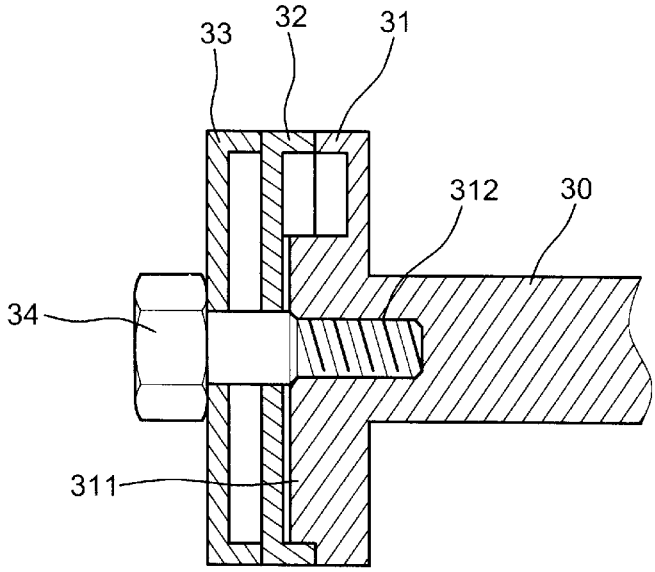
FIG. 5 is a sectional view to show the engagement of the circular seats with the circular plate.
Figure 7:
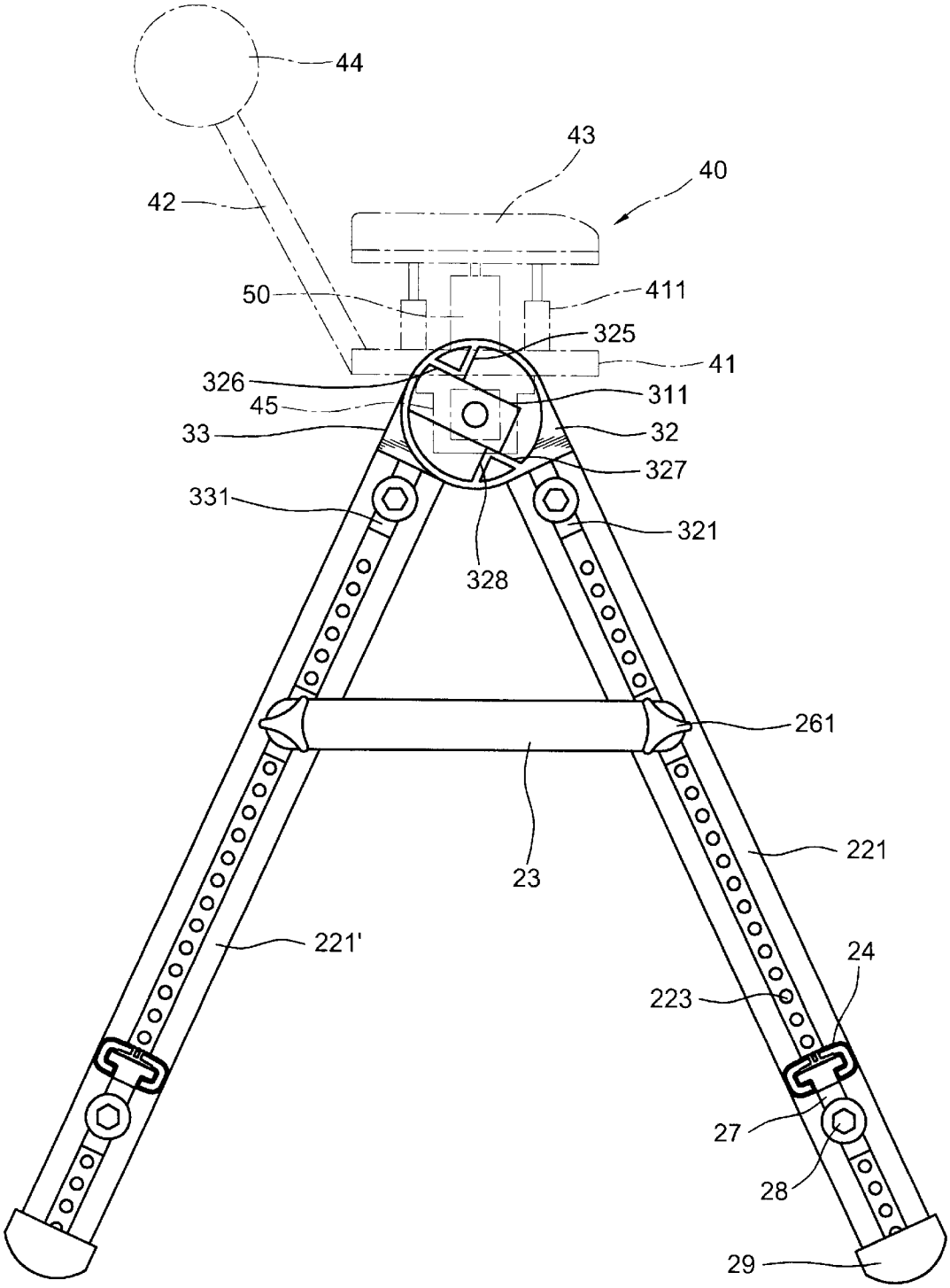
FIG. 7 is an elevational view of FIG. 6 while the massage assembly rotates clockwise for about 90 degrees.
Figure 8:
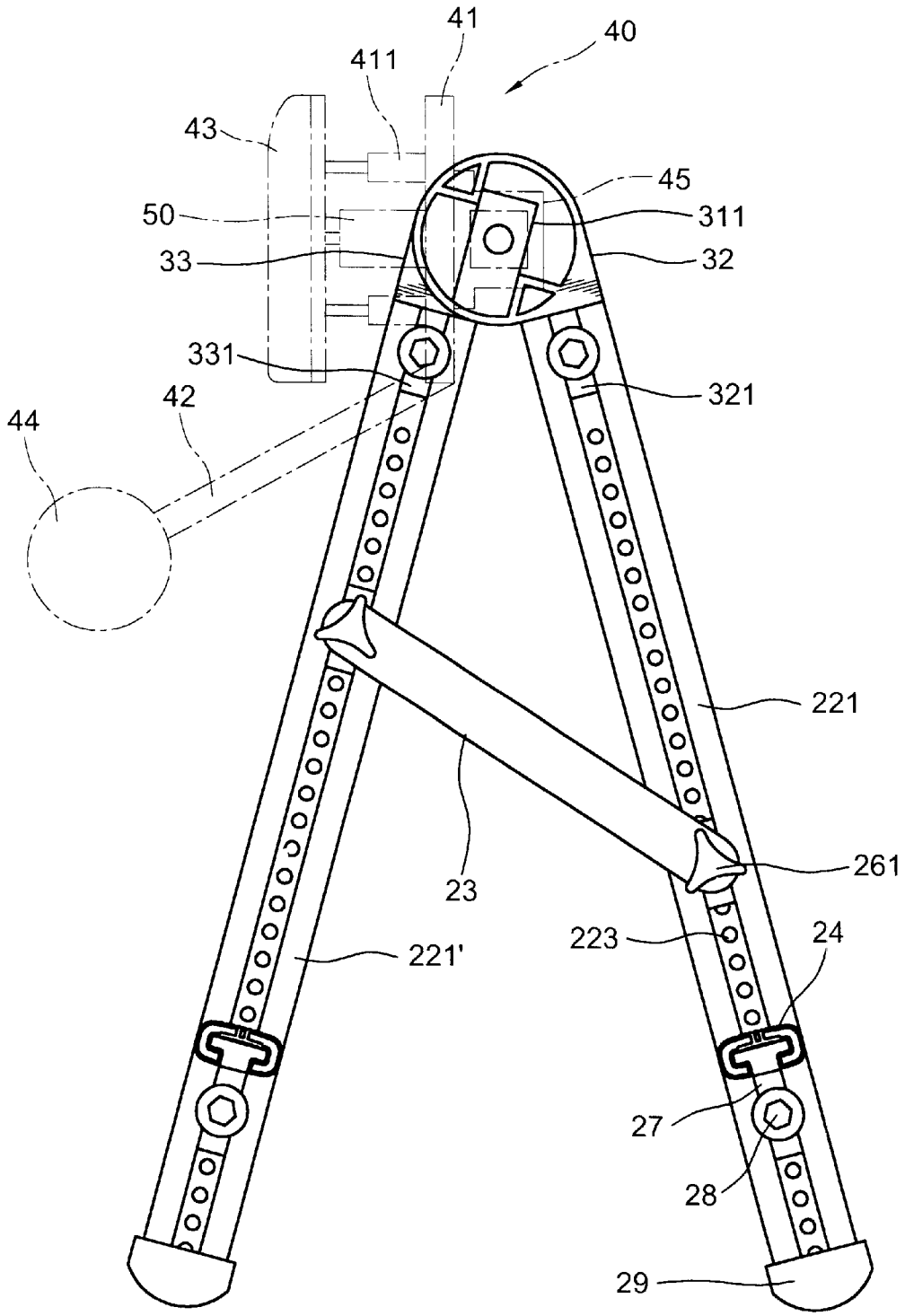
FIG. 8 is an elevational view to show the adjustment of the height of the support.

A pair of circular seats 32 and 33 for connecting each of the A-shaped stands 21 and 22 wherein the circular seat 32 has a first T-shaped extension 321 projected downward from a lower circumference suitable to insert into the guard 222 from the top of an inner leg 221 and secured by a bolt 322 with a washer 323 engaged therebetween, a central bore 324 and a pair of L-shaped ribs symmetrically formed on inner side to define a pair of vertical damping surfaces 325 and 328 and a pair of transverse damping surfaces 326 and 327 inside the seat 32. The circular seat 33 has a central bore 334 and a second T-shaped extension 331 projected downward from an arcuate protrusion under a lower circumference suitable to insert into the top of the outer leg 221' and secured by a bolt 332 with a washer 333 engaged therebetween. When assembling, the seat 33 is positioned at outside of the seat 32 so that the legs 221 and 221' will not be alternate (as shown in FIGS. 2, 5 and 6). Further, the spindles 23 are normally at a horizontal position (as shown in FIG. 7). If adjusts the height of the stand 21 and 22, one end of them may be moved up or down in the guard 222 (as shown in FIG. 8).

The rotatable top bar 30 has an elongate rectangular body, a disk 31 perpendicularly integrated with each end. The disks 31 each has a rectangular block 311 projected outward from a center reinforced by ribs and a screw hole 312 in the center of the block 311. When assembling, the disks 31 are respectively disposed into the circular seats 32 and the lateral sides of the rectangular block 311 are respectively engaged with the vertical damping surfaces 235 and 238 when the top bar 30 remains at normal position. The disks 31 are secured by a pair of big bolts 34 through the central bores 324 and 334 of the circular seat 32 and 33 (as shown in FIG. 5). So that the disks 31 are rotatable for about 90 degrees in the circular seats 32 (as shown in FIG. 7).

The massage assembly 40 comprises a rectangular base 41 secured to the rotatably rectangular top bar 30 by a rectangular sleeve 45 (as shown in FIG. 6), a massage plate 43 connected to the base 41 through a plurality of elastic rods 411 and a vibration motor 50 which provides proper vibrations to the massage plate 43, a lilting rod 42 centrally extended downward from the underside of the base 41 and a pillow cushion 44 perpendicularly connected to the lower end of the tilting rod 42 (as shown FIGS. 2 and 6).

Figure 9:
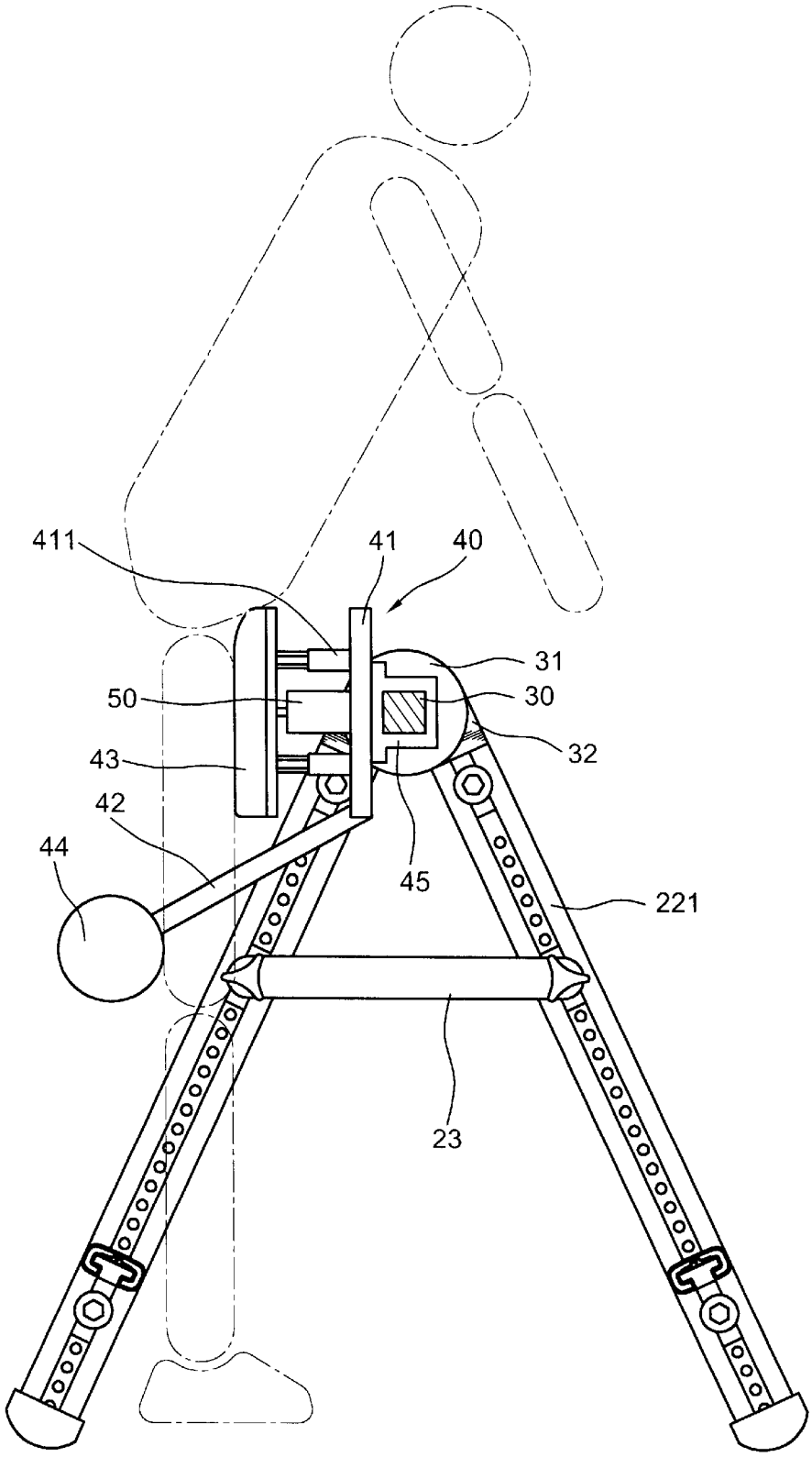
FIG. 9 is an elevational view indicating a human standing up against the massage assembly.
Figure 10:
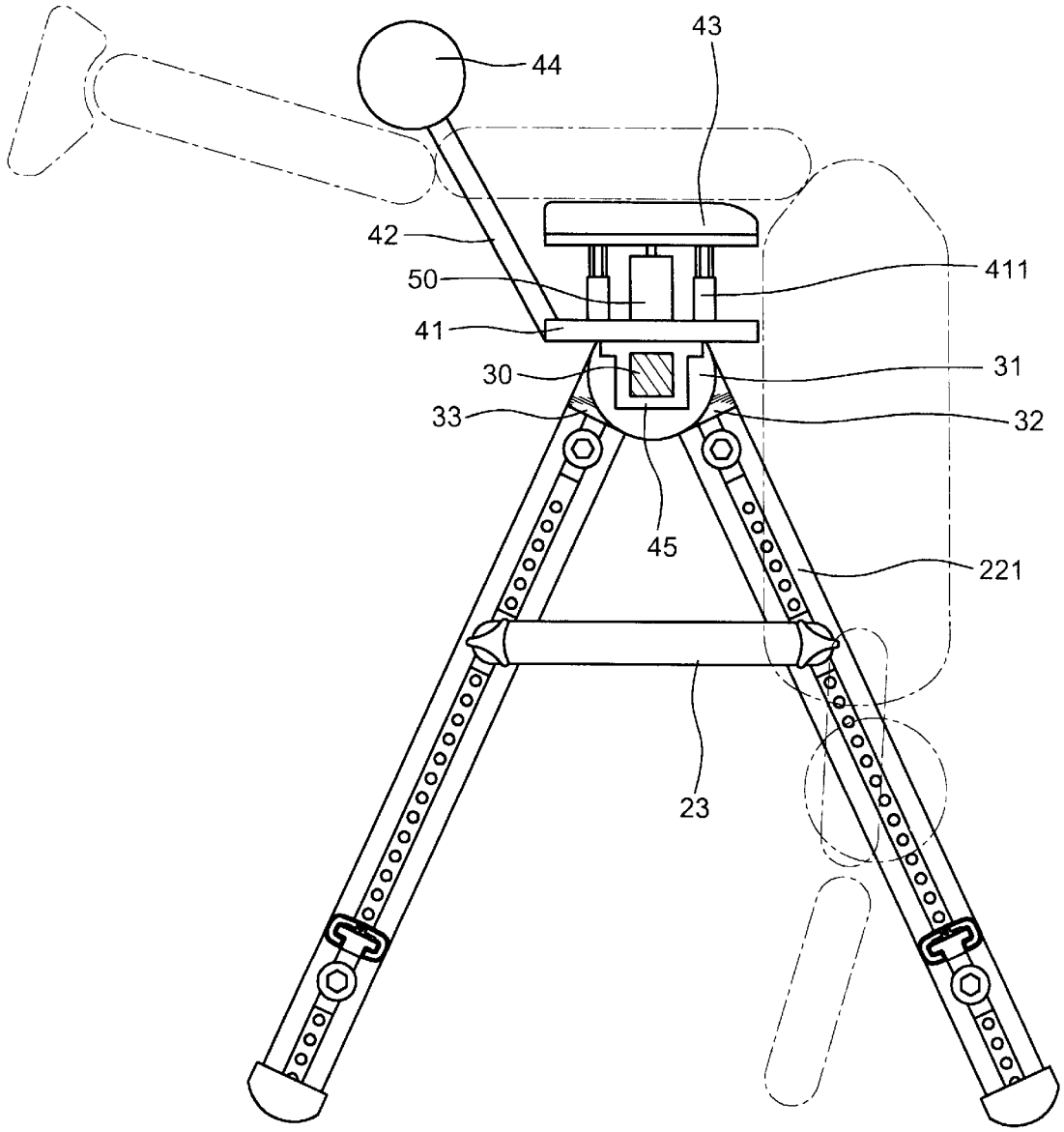
FIG. 10 is an elevational view indicating that the human body is bowed upside down on the massage assembly while it turns clockwise for about 90 degrees.

Referring to FIGS. 9 and 10, in operation, the user first adjusts the height of the support 20 in accordance with the tallness of his body and turns on the vibration motor 50, then stands up between the massage plate 43 and the pillow cushion 44 (as shown in FIG. 9) and then bows his upper body downward to rotate the massage assembly 40 for about 90 degrees so that he is hanging upside down on the massage assembly 40 (as shown in FIG. 10). Therefore, his vertebra is loose and relaxing without pressure and his thigh under massage to improve the blood circulation in his body that benefits his health condition. When the user's hands apply a slight pressure to the legs 221 and 221', the massage assembly 40 will turn back to normal position. So he is standing up again.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A health machine for enabling an user to exercise upside dower comprising:

a support having a pair of A-shaped stands each of which has a pair of first and second legs and each of the first and second legs having an elongate guard of T-shaped section extending along the length thereof, a plurality of screw holes centrally formed spaced apart in the guard and extending along the length thereof and a foot on bottom;

a slide of T-shaped section slidably engaged into the T-shaped guard of each of the first and second legs at middle portion thereof and having a screw hole centrally formed through the body engageable with the screw holes of the legs;

a L-shaped block having a T-shaped vertical portion engaged into the guard of each of the first and second legs at lower portion thereof, said vertical portion having a screw hole engaged with the screw hole of the legs and secured bolt with a washer disposed therebetween and a T-shaped transverse portion extending outward from the first and second legs and having a vertical screw hole centrally formed through the body;

a spindle for each of the A-shaped stands having a pair of thru hole respectively formed adjacent two ends thereof engaged with the screw hole of the slides and the screw holes of the legs and secured by locks;

a pair of first and second lower bars for connecting the pair of A-shaped stands each having a T-shaped guard formed along the length thereof engageable with the T-shaped transverse portion of each of the L-shaped blocks, said first lower bars having two end connected with the transverse portion of the L-shaped blocks from the first legs of the A-shaped stands, and the second lower bar having two ends connected with the transverse portions of the L-shaped blocks from the second legs of the A-shaped stands;

a pair of first and second circular seats for each of the A-shaped stands wherein the first circular seat having a first T-shaped extension projected downward from a lower circumference to insert into the guard from top of the first leg and secured by bolt with a washer engaged therebetween, a first central bore and a pair of L-shaped ribs symmetrically formed at opposing circumferences to define a pair of vertical damping surfaces and a pair of transverse damping surfaces inside the first circular seat, the second circular seat juxtaposed the first circular seat having a second central bore engaged with the first central bore of the first circular seat and a second T-shaped extension projected downward from an arcuate protrusion abutting a lower circumference to insert into the guard from top of the second leg and secured by a bolt with a washer engaged therebetween;

a rotatably top bar having an elongate rectangular body, a disk perpendicularly integrated with each end made engageable with the first circular seats of the A-shaped stands, said disks each having a rectangular block centrally projected outward from inner surface thereof reinforced by ribs and engaged within the first circular seats with two lateral sides engaged with the vertical damping surfaces of the L-shaped ribs and a screw hole centrally formed in the rectangular block engaged with the central bars of the first and second circular seat and rotatably secured by a pair of big bolts;

a massage assembly having a rectangular base secured to the rotatable top bar by a rectangular sleeve, a massage plate connected to the base through a plurality of elastic rods and a vibration motor which provides proper vibrations to the massage plate, a tilting rod centrally extending downward from an underside of the base and a pillow cushion perpendicularly connected to a lower end of the tilting rod.

2. The health machine as recited in claim 1 wherein said massage assembly can rotate clockwise for about 90 degrees.

3. The health machine as recited in claim 1 wherein said A-shaped stands can be elevationally adjusted.

* * * * *